United States Patent [19]

Turner

[11] Patent Number: 5,050,784

[45] Date of Patent: Sep. 24, 1991

[54] BOOTJACK STAND WITH REMOVABLE BOOTJACK AND SUPPORT POSTS

[76] Inventor: Posie C. Turner, 815 57th Pl., NE., Fairmount Heights, Md. 20743

[21] Appl. No.: 546,803

[22] Filed: Jul. 2, 1990

Related U.S. Application Data

[63] Continuation-in-part of Ser. No. 273,441, Nov. 18, 1988, abandoned.

[51] Int. Cl.[5] ..... A47G 25/80; A47G 25/84; A47G 25/86

[52] U.S. Cl. ..... 223/114; 223/111; 223/113; 223/120; D2/641; D2/642

[58] Field of Search ..... 223/114, 113, 111, 112, 223/115, 116, 117, 120; D2/641, 642

[56] References Cited

U.S. PATENT DOCUMENTS

| | | | |
|---|---|---|---|
| 8,865 | 4/1852 | Thompson | 223/117 |
| 112,638 | 3/1871 | Rouard | 223/117 |
| 459,680 | 9/1891 | Donaue | 223/114 |
| 612,764 | 9/1898 | Anderson | 223/117 |
| 835,147 | 11/1906 | Weber | 223/117 |
| 1,178,109 | 4/1916 | Staubly | 223/114 |
| 4,226,346 | 10/1980 | Turner | 223/115 |
| 4,666,070 | 5/1987 | McClurg | 223/117 |
| 4,768,687 | 9/1988 | Ault | 223/116 |

*Primary Examiner*—Werner H. Schroeder
*Assistant Examiner*—Bibhu Mohanty
*Attorney, Agent, or Firm*—Sughrue, Mion, Zinn, Macpeak & Seas

[57] ABSTRACT

A bootjack stand includes a broad, flat support plate having at least one bootjack detachably mounted thereon between with a pair of upstanding support posts detachably secured to the support plate to assist a person in maintaining balance during boot removal.

3 Claims, 3 Drawing Sheets

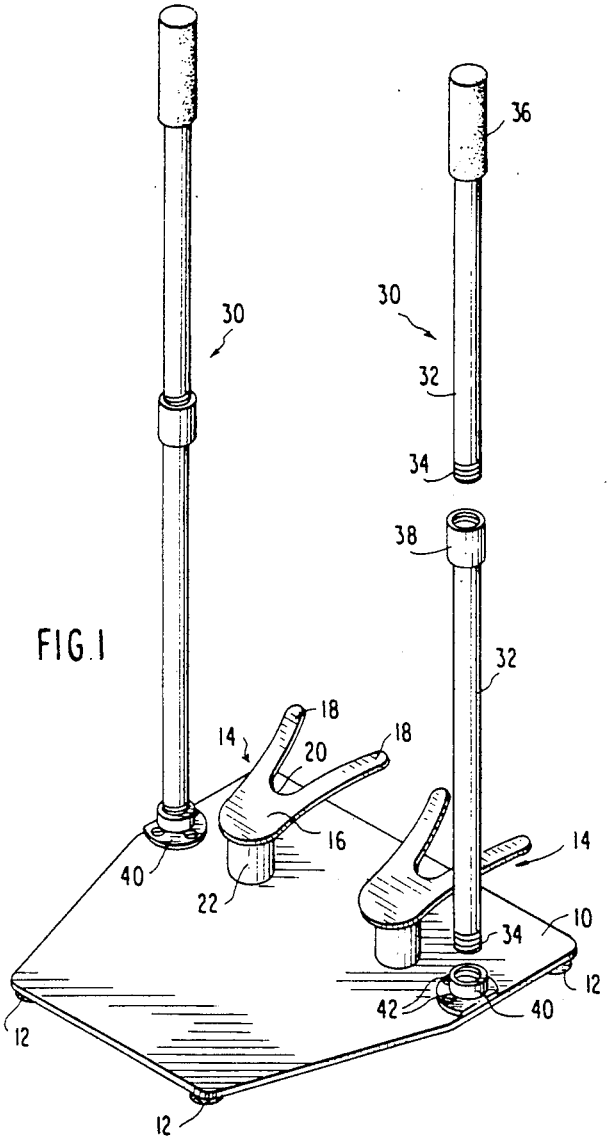
FIG. 1
FIG. 2
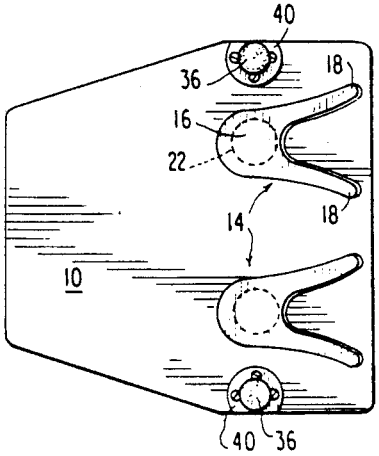
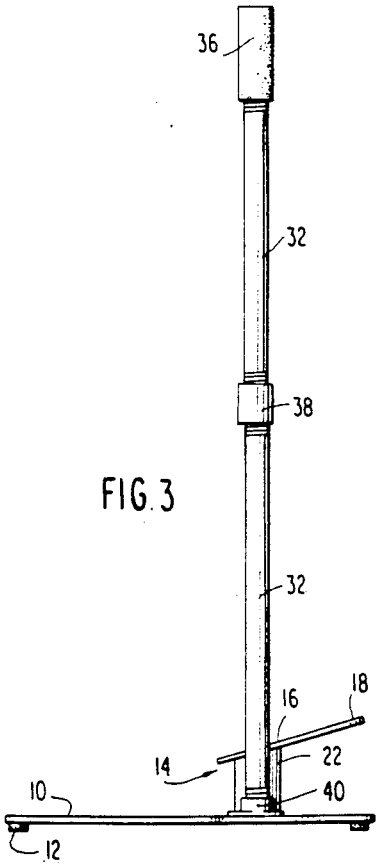
FIG. 3
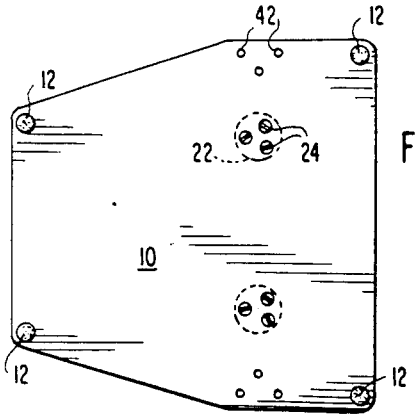
FIG. 4

BOOTJACK STAND WITH REMOVABLE BOOTJACK AND SUPPORT POSTS

RELATED APPLICATION

The present application is a Continuation-In-Part of application Ser. No. 07/273,441 filed Nov. 18, 1988, abandoned Nov. 5, 1990.

BACKGROUND OF THE INVENTION

The present invention is directed to a bootjack stand and more specifically to a bootjack stand having at least one bootjack disposed on an enlarged support plate for removing boots from the left foot and right foot and a pair of support posts on opposite sides of the bootjack for maintaining balance during boot removal.

Ordinarily, a single bootjack is provided for the removal of boots from the left foot and the right foot in a sequential manner. Such a bootjack is further secured directly to the floor or ground or must be held down with one foot while the boot is being removed from the other foot.

Applicants' prior U.S. Pat. No. 4,226,346 granted Oct. 7, 1980, is directed to a compact foldable bootjack with a positive locking device. The bootjack as disclosed in this patent does not have any positive means for securing the bootjack to the floor and therefore, it is necessary for the person removing a boot to place the other foot on the inclined surface of the bootjack to hold the bootjack in place while a boot is being removed from the other foot. Thus, with both feet disposed substantially in fore and aft alignment, it is difficult for a person to maintain their balance during boot removal.

It is also known in the art to provide means for supporting a pair of boots on a platform in a manner which will assist a person in inserting and removing their feet from the boots. It is also known to secure a pair of brackets on a platform having horizontally disposed heel gripping means of the type suitable for low-rise shoes. With this type of bracket, a person would stand on the platform and back their shoe into the device which would then hold the shoe down while the person lifted their foot from the shoe.

SUMMARY OF THE INVENTION

The present invention is directed to a new and improved bootjack which overcomes the forementioned difficulties with respect to prior art bootjack devices.

The present invention provides a new and improved bootjack stand comprised of a flat support plate adapted to be placed directly on the floor or ground, a pair of bootjacks mounted on an upper surface of the support plate at an angle thereto in side by side relation and a pair of support posts mounted on opposite sides of the bootjack to assist a person in maintaining balance during removal of a boot.

The present invention provides a new and improved bootjack stand comprising a single bootjack mounted on an upper surface of a support plate at an angle thereto with a pair of support posts mounted on opposite sides of the bootjack. The support plate and three socket members for receiving the support posts and bootjack are cast in one piece from aluminum with the socket of the socket member for receiving the bootjack being disposed at an acute angle to said plate. The bootjack is comprised of a flat, U-shaped plate having a depending support pin extending parallel to the U-shaped plate which is also cast in one piece from aluminum. The support pin for the bootjack is adapted to be detachably secured in the angled socket so that the flat U-shaped plate of the bootjack is disposed at an acute angle relative to the support plate.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a perspective view of a bootjack stand according to a first embodiment of the present invention.

FIG. 2 is a top plane view of the bootjack stand as shown in FIG. 1.

FIG. 3 is a side elevational view of the bootjack stand as shown in FIG. 1.

FIG. 4 is a bottom plane view of the bootjack stand as shown in FIG. 1.

DETAILED DESCRIPTION OF THE INVENTION

Figure 5:
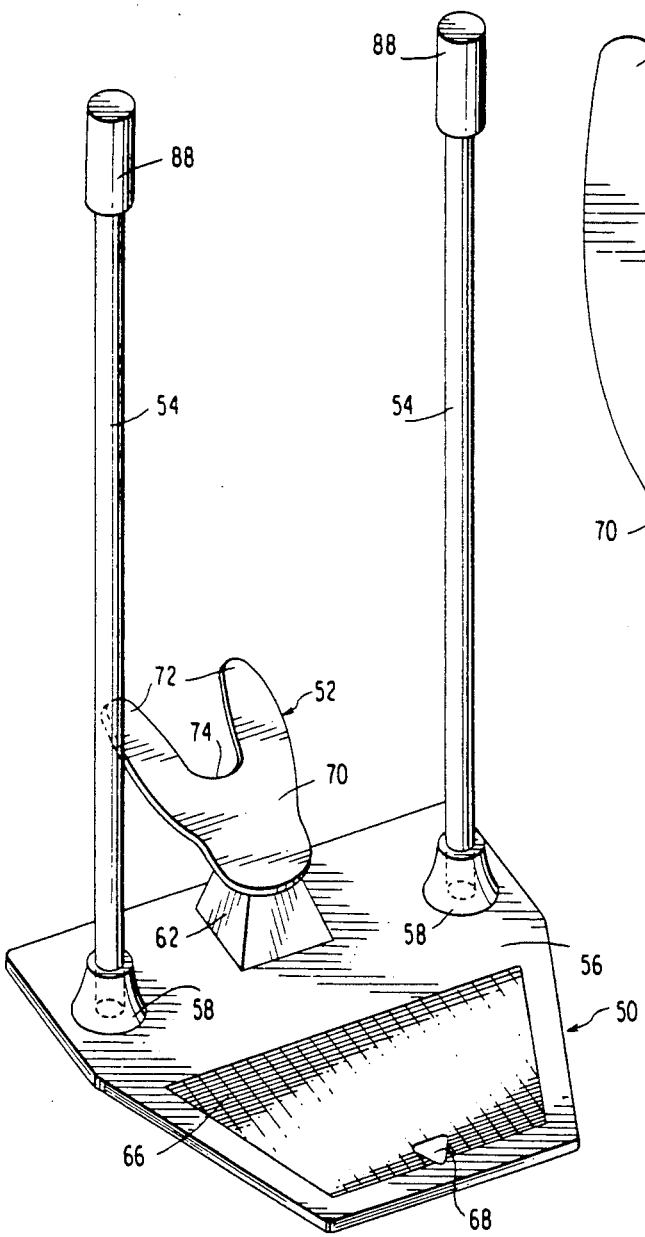
FIG. 5 is a perspective view of a bootjack stand according to a second embodiment of the present invention.
Figure 6:
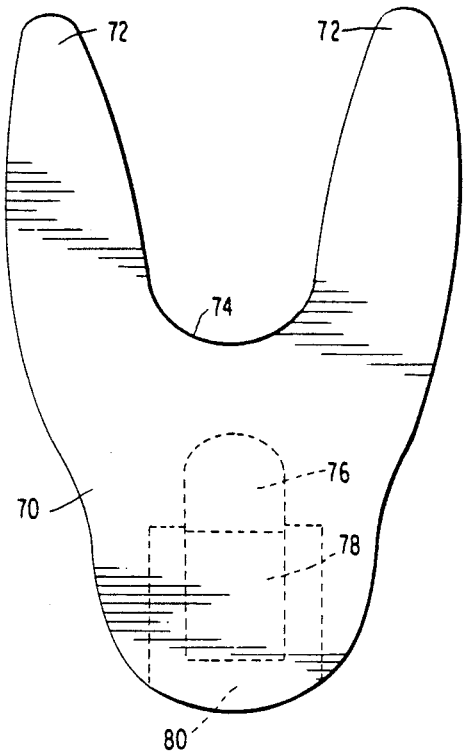
FIG. 6 is a top plane view of the bootjack member per se.

The bootjack stand according to the first embodiment is comprised of a flat, substantially rectangular support plate 10 having a plurality of support feet 12 secured to the lower surface thereof by any suitable means. The support feet 12 may be of rubber or any other suitable antiskid material to prevent the support plate 10 from sliding on a smooth surface. In fact, the support feet 12 can even take the form of rubber suction cups. When the support plate is mounted on a carpet or directly on the ground, the support feet 12 can take the form of spikes to anchor the plate against sliding movement. The material of the support plate 10 may be wood, metal or plastic.

A pair of identical bootjacks 14 are secured to the upper surface of the support plate 10. Each bootjack 14 is comprised of a flat plate 16 having a pair of diverging fingers 18 defining a curved recess 20 therebetween. The plate 16 is mounted at an inclined angle relative to the support plate 10 by means of a cylindrical support post 22 which in turn is secured to the support plate 10 by means of a plurality of screws 24 as shown in FIG. 4. The plate 16 and the cylindrical post 22 are preferably formed of metal and may be secured to each other by welding, brazing or any other suitable connection or may be cast as a single piece from aluminum. Likewise, the support post 22 may be secured to the base by any other suitable means. It is possible to manufacture the bootjack from other materials. For example, the plate 16 and the cylindrical support post 22 could be formed as a one-piece injection molded plastic member.

In order to assist a person in maintaining their balance during boot removal, a pair of identical support posts 30 are provided on the upper surface of the support plate 10 adjacent each bootjack. As shown in FIG. 1, each support post 30 may be comprised of a pair of identical hollow tubular pipes 32 having external threads 34 formed at opposite ends thereof. A tubular handle 36 having internal threads is screwed on the upper end of the uppermost pipe 32 and the two pipes are connected together by means of an internally threaded connector sleeve 38. A flanged connector 40 having internal threads is secured to the support plate 10 by means of screws 42 and the lower end of the lower pipe 32 is threaded into the support member 40. The support posts 30 are formed as detachable components so that the posts may be readily disassembled to facilitate shipping and storage of the bootjack stand. However, it is possible to make these support posts 30 of other materials and in other configurations. The support posts 30 may be secured to the support plate 10 by any suitable means. The primary purpose of the support posts is to help a person maintain their balance during boot removal. Since the bootjacks are secured to the upper surface of a broad flat plate, a person removing their boots does not have to assume the awkward position of holding the bootjack in position with one foot while trying to remove a boot from the other foot.

According to a second embodiment of the invention, as shown in FIGS. 5–8, the bootjack stand 50 contains only a single bootjack 52 and a pair of support posts 54 mounted on the upper surface of a substantially rectangular support plate 56. The support posts 54 are mounted in a pair of respective socket members 58, each having a socket 60 therein having a vertically disposed axis extending perpendicular to the upper surface of the support plate 56. The bootjack 52 is supported in a socket member 62 having a cylindrical socket 64 therein disposed at an acute angle relative to the upper surface of the support plate 56.

The three socket members 58, 58 and 62 and the support plate 56 are cast as a single piece from aluminum to provide a sturdy, rigid and stable support for the posts and the bootjack. The upper surface of the support plate 56 may be provided with a plurality of diamond shaped recesses 66 which provide an anti-skid or anti-slip surface on that portion of the upper surface of the support plate 56 upon which a person would be standing. Thus, if the person's boots are covered with mud or ice, the roughened surface will prevent a person from slipping while removing the boots. The diamond shaped pattern portion 56 may be cast directly into the support plate and an aperture 68 is also formed during the casting process so that the support plate can be hung on a hook when not in use.

Figure 7:
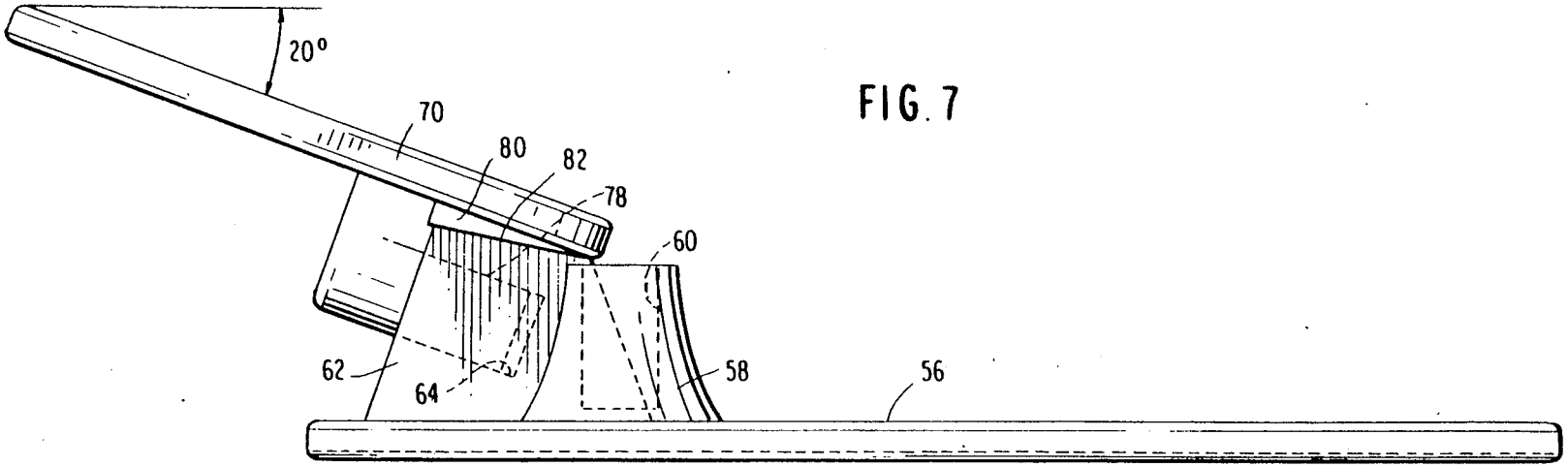
FIG. 7 is a side elevation view of the bootjack stand as shown in FIG. 1 with the support posts removed.
Figure 8:
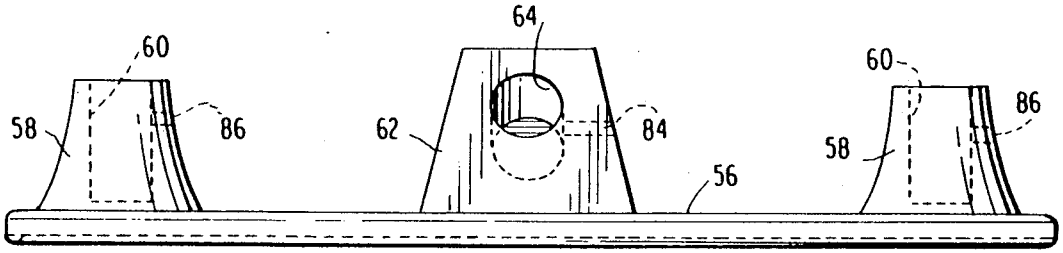
FIG. 8 is a front elevation view of the support stand as shown in FIG. 1 without the support posts and bootjack.

The bootjack 52 is comprised of a flat, substantially U-shaped plate 70 having a pair of diverging finger portions 72 defining a curved recess 74 therebetween into which the heel of the boot may be placed for removing the boot from the foot of a person. As best seen in FIG. 7, the plate 70 is formed with a downwardly extending projection 76 which is disposed at right angles to the plane of the plate 70 and having a cylindrical pin 78 integrally formed therewith and extending in parallel spaced relation to the plate 70. A wedge-shaped abutment member 80 is formed on the bottom surface of the plate 70 adjacent the support pin 78. Thus, when the support pin 78 is fitted into the socket 64 of the socket member 62, the bottom surface of the wedge-shaped member 80 will abut the upper surface 82 of the socket member 62. The support plate 70, the projection 76, the support pin 78 and the wedge-shaped member 80 are all formed as an integral one piece casting from aluminum. While the support pin 78 and the socket 64 are dimensioned to provide a close friction fit, a set screw 84 may also be provided to secure the support pin within the socket to securely anchor the bootjack on the base plate 56.

The support posts 54 may be identical to the support posts 30 described in the first embodiment. The lower ends of the support posts 54 are adapted to be inserted into the sockets 60 in the socket members 58 and secured therein by means of set screws 86. The upper ends of the support posts 54 may be provided with suitable hand grips 88.

While the invention has been particularly shown and described with reference to preferred embodiments thereof, it will be understood by those in the art that the foregoing and other changes in form and details may be made therein without departing from the spirit and scope of the invention.

What is claimed is:

1. A bootjack stand comprising a flat support plate adapted to rest directly on the floor or ground and at least one bootjack secured to said support plate, said support plate having socket means on an upper surface thereof with said support plate and socket means being formed of integral one piece die-cast construction, said socket means having a socket disposed at an acute angle to said upper surface of said support plate and said bootjack being comprised of a flat, substantially U-shaped plate having a downwardly extending projection on a lower surface thereof with a cylindrical pin extending therefrom in parallel spaced relation to said flat U-shaped plate with said flat, U-shaped plate, said projection and said pin being formed of integral one piece die-cast construction, said pin being detachably mounted in said socket.

2. A bootjack stand as set forth in claim 1, further comprising additional socket means on said upper surface of said support plate of integral one piece die-cast construction therewith and having sockets therein with vertical axes disposed perpendicular to said upper surface of said support plate and wherein said support means is comprised of a pair of support posts detachably mounted in said sockets.

3. A bootjack stand as set forth in claim 2, wherein said pin and said posts are secured in respective sockets by means of set screws.

* * * * *